US007963086B2

(12) United States Patent
Porter et al.

(10) Patent No.: US 7,963,086 B2
(45) Date of Patent: Jun. 21, 2011

(54) PACKAGE UNBUNDLING SYSTEM

(75) Inventors: Dale G. Porter, South Lake, TX (US); Dan C. Porter, Grand Rapids, MI (US); Robert J. Schafer, Belding, MI (US); Larry R. Magnuson, Muskegon, MI (US)

(73) Assignee: Porter Technologies, LLC, Grand Rapids, MI (US)

( * ) Notice: Subject to any disclaimer, the term of this patent is extended or adjusted under 35 U.S.C. 154(b) by 5 days.

(21) Appl. No.: 12/260,401

(22) Filed: Oct. 29, 2008

(65) Prior Publication Data

US 2009/0113853 A1 May 7, 2009

Related U.S. Application Data

(60) Provisional application No. 60/985,790, filed on Nov. 6, 2007.

(51) Int. Cl.
*B65B 43/26* (2006.01)

(52) U.S. Cl. ..... 53/381.2; 53/381.1; 53/492

(58) Field of Classification Search ..... 53/492, 53/381.1, 381.2, 381.4
See application file for complete search history.

(56) References Cited

U.S. PATENT DOCUMENTS

| | | | | |
|---|---|---|---|---|
| 2,729,885 | A | | 1/1956 | Wahl et al. |
| 2,732,619 | A | | 1/1956 | Labine |
| 3,175,288 | A | | 3/1965 | Garwick et al. |
| 3,889,442 | A | | 6/1975 | Grahn et al. |
| 3,922,778 | A | | 12/1975 | Aalpoel |
| 4,107,905 | A | | 8/1978 | Grocke et al. |
| 4,344,268 | A | | 8/1982 | Wakamatsu et al. |
| 4,390,313 | A | | 6/1983 | Hoehn |
| 4,457,123 | A | | 7/1984 | Hoehn |
| 4,696,615 | A | | 9/1987 | Ettischer et al. |
| 4,817,260 | A | * | 4/1989 | Martin ..... 29/426.6 |
| 4,997,329 | A | | 3/1991 | Hanamoto et al. |
| 5,048,267 | A | | 9/1991 | Kudo et al. |
| 5,090,573 | A | * | 2/1992 | Takahashi et al. ..... 209/534 |
| 5,101,703 | A | | 4/1992 | Tanaka et al. |
| 5,148,651 | A | | 9/1992 | Masuda et al. |
| 5,275,524 | A | | 1/1994 | Ishiwata |
| 5,282,346 | A | | 2/1994 | Masuda et al. |
| 5,318,399 | A | * | 6/1994 | Marom ..... 414/412 |
| 5,371,938 | A | | 12/1994 | Martin |
| 5,423,649 | A | | 6/1995 | Maeda et al. |

(Continued)

FOREIGN PATENT DOCUMENTS

EP 0142846 5/1985

(Continued)

*Primary Examiner* — Christopher Harmon
(74) *Attorney, Agent, or Firm* — Price, Heneveld, Cooper, DeWitt & Litton, LLP

(57) ABSTRACT

A package unbundling station receives bundles of articles to be unwrapped. The station includes a clamp for holding a bundle in a fixed position and a pair of spaced-apart movable cutter assemblies which cut at least one of wrapping and banding on at least two sides of the bundle, resulting in an "open envelope" which is transferred to a work station for easy removal of the articles which are then conveyed for subsequent sorting. In one embodiment, an unbundling station is coupled with a package sorting system and receives banded and/or wrapped bundles of articles and includes at least a pair of spaced-apart movable cutter assemblies which cut at least one of the banding and/or wrapping materials of the bundle and subsequently outputs the opened bundle to an output station for subsequent processing.

12 Claims, 15 Drawing Sheets

U.S. PATENT DOCUMENTS

| | | | | | |
|---|---|---|---|---|---|
| 5,425,219 | A | | 6/1995 | Tanaka et al. | |
| 5,442,895 | A | | 8/1995 | Linson | |
| 5,454,683 | A | | 10/1995 | Marom et al. | |
| 5,463,841 | A | | 11/1995 | Hayakawa et al. | |
| 5,680,691 | A | * | 10/1997 | Marom et al. | 29/564.3 |
| 5,725,349 | A | | 3/1998 | Garvey et al. | |
| 5,727,747 | A | | 3/1998 | Hannen et al. | |
| 5,752,359 | A | | 5/1998 | Oord | |
| 5,758,362 | A | | 6/1998 | Focke et al. | |
| 6,714,834 | B1 | * | 3/2004 | Roth et al. | 700/217 |
| 6,725,631 | B2 | | 4/2004 | Skrak et al. | |
| 6,766,630 | B2 | | 7/2004 | Rutten | |
| 7,174,695 | B2 | | 2/2007 | Porter et al. | |
| 7,647,684 | B2 | * | 1/2010 | Redford et al. | 29/426.4 |
| 2009/0301031 | A1 | * | 12/2009 | Jacobs et al. | 53/381.2 |

FOREIGN PATENT DOCUMENTS

| | | | |
|---|---|---|---|
| EP | 0587051 | | 3/1994 |
| JP | 1037333 | | 2/1989 |
| JP | 1111642 | | 4/1989 |
| JP | 2152643 | | 6/1990 |
| JP | 5139426 | | 6/1993 |
| WO | WO 2008/052176 | * | 5/2008 |

* cited by examiner

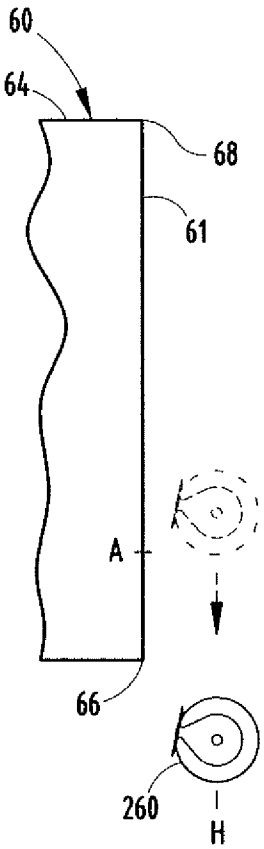
FIG. 12A
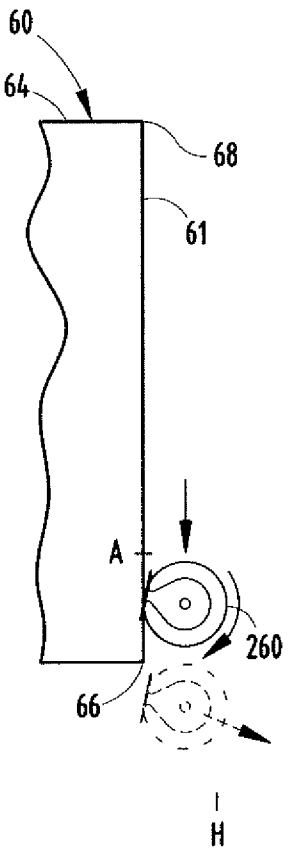
FIG. 12B
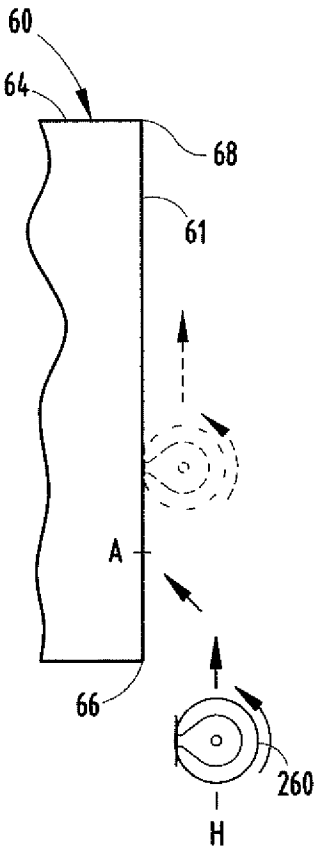
FIG. 12C
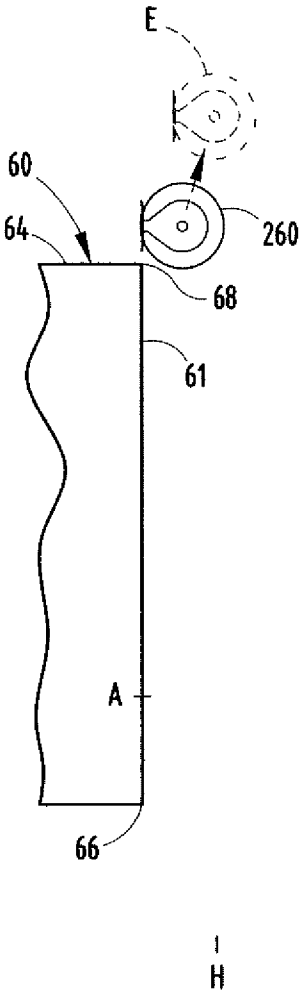
FIG. 12D
FIG. 12E

PACKAGE UNBUNDLING SYSTEM

CROSS-REFERENCE TO RELATED APPLICATIONS

This application claims priority under 35 U.S.C. §119 (e) on U.S. Provisional Application No. 60/985,790 entitled PACKAGE UNBUNDLING SYSTEM, filed on Nov. 6, 2007, by Dale G. Porter, et al., the entire disclosure of which is incorporated herein by reference.

BACKGROUND OF THE INVENTION

The present invention relates to a system for opening bundles of flat mail and particularly to a system for cutting bands and/or overwrap material of bundles of flat mail, including articles such as magazines, catalogs, brochures, and the like, to allow easy removal of such articles from the packaging.

Publishers and printers typically provide packages of pre-addressed magazines, catalogs, brochures and other bound mail items to a postal distribution center for opening, subsequent sorting, and subsequent delivery to a local post office. These packages are generally referred to as bundles and are typically grouped according to zip codes. Such bundles range greatly in size, including height, width, and length depending upon the type of magazine and the number of magazines/catalogs destined for a particular zip code. Such bundles may have a film wrapping material, orthogonal circumscribing bands, or both for packaging. The banding may be inside or outside of the film. The bundles may include sequential addressees on a given street(s) which, when the bundles are opened, are subsequently sorted and delivered to a mail carrier for sequential delivery to the addressees along the carrier's route.

The unbundling or unbundling step has typically been accomplished manually by an operator cutting the bands and the overwrap with a knife, removing the remnants of the wrap and/or bands, aligning the spines of the articles, and subsequently placing the stack of articles into a mobile cart or conveyable "bucket" for subsequent machine reader identification and sorting according to address. This manual unbundling process is both time consuming, expensive, and prone to causing personal injuries in the form of carpel tunnel syndrome, cuts, and, in some cases, results in damage to the articles due to the manual cutting of the overwrap. U.S. Pat. No. 7,174,695 describes an automated process for unbundling such bundles of flat mail and represents a significant advancement in the mail sorting and delivery process. Nonetheless, there remains a need for a fast, less expensive and at least partially automated system for unbundling flat mail.

SUMMARY OF THE INVENTION

The system of the present invention accomplishes this goal by providing in combination, in one aspect of the invention, a package handling system including an unbundling station which communicates with an input conveyor of the handling system and receives packages of articles to be unwrapped. The handling system includes an input conveyor and loading and transfer stations which measure the size of incoming bundles and singulates them for subsequent unbundling. A downstream unbundling station includes a pair of movable cutter assemblies which cut at least one of wrapping and banding on at least two sides of the package, resulting in an "open envelope". The opened bundles are transferred to one or more work stations for easy removal of the articles, which are then manually aligned and placed in empty "buckets" which are then conveyed for subsequent automatic address sorting. The unbundling station in one embodiment includes a clamp for holding a bundle in a fixed position during the cutting operation.

In another embodiment of the invention, a unbundling station alone is provided which receives banded and/or wrapped bundles of articles and includes at least a pair of movable cutter assemblies which cut at least one of the banding and/or wrapping materials of the bundle and subsequently outputs the opened bundle to an output station for subsequent processing. In a preferred embodiment, a clamp holds the bundles in a fixed position in the unbundling station and the cutters cut through at least three corners of the wrapping and the sides between the corners.

These and other features, objects and advantages of the present invention will become apparent upon reading the following description thereof together with reference to the accompanying drawings.

BRIEF DESCRIPTION OF THE DRAWINGS

FIGS. 12A-12E are sequence plan schematic drawings of a cycle of operation of one of the cutter assemblies while cutting the overwrap and band of a wrapped and banded bundle;

DETAILED DESCRIPTION OF THE PREFERRED EMBODIMENT

Figure 15A:
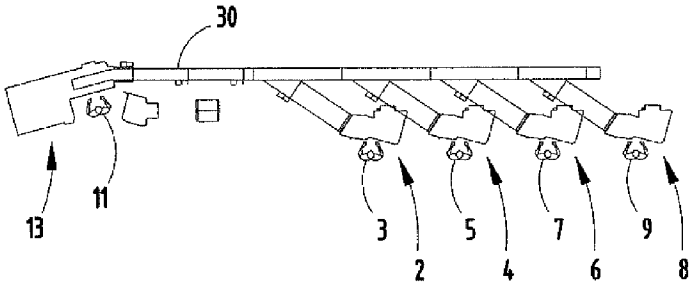
FIGS. 15A-15E are plan views of components of a system for processing bulk flat bundles of mail and sorting such mail for subsequent delivery.
Figure 15B:
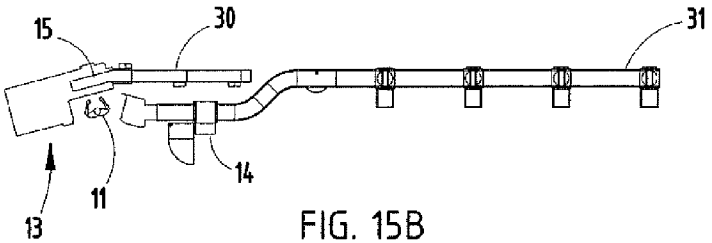
Figure 15C:
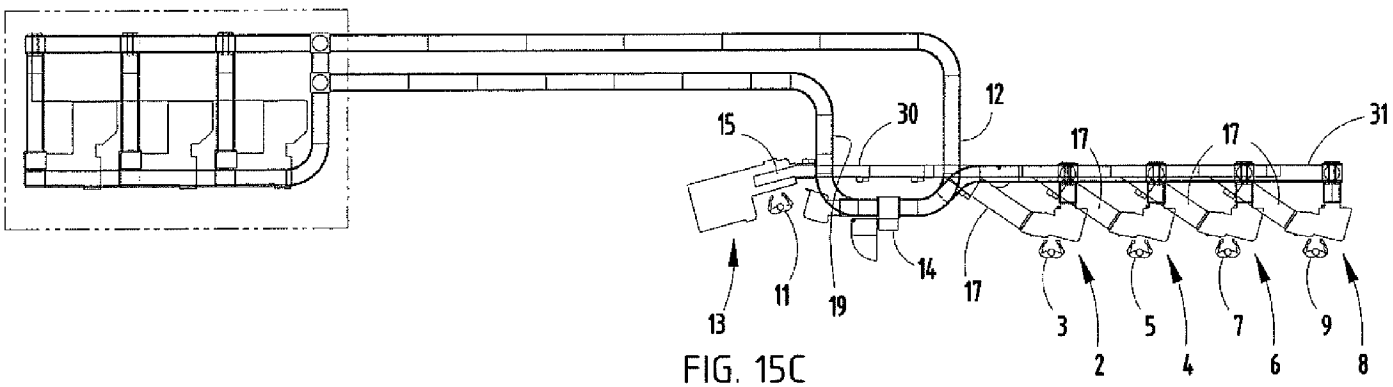
Figure 15D:
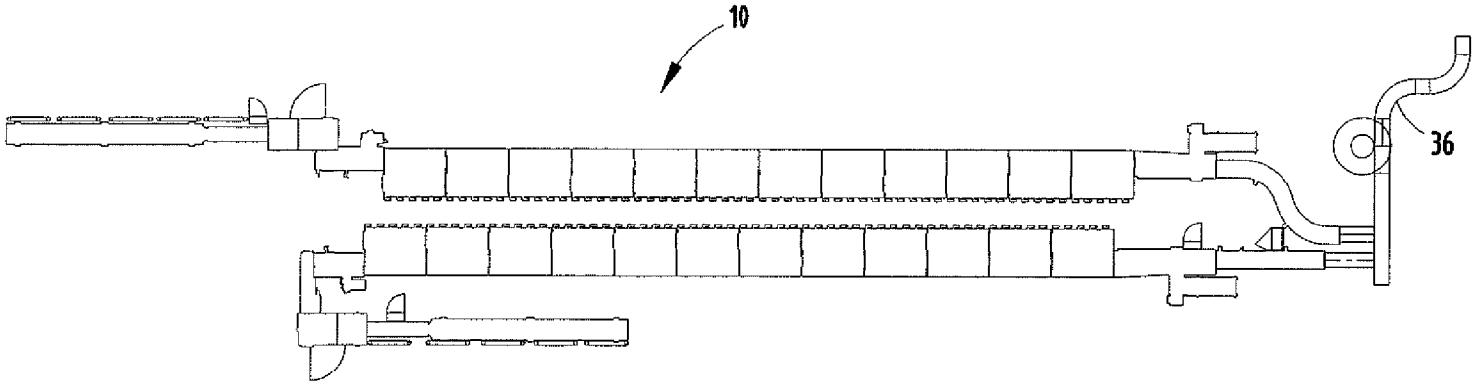
Figure 15E:
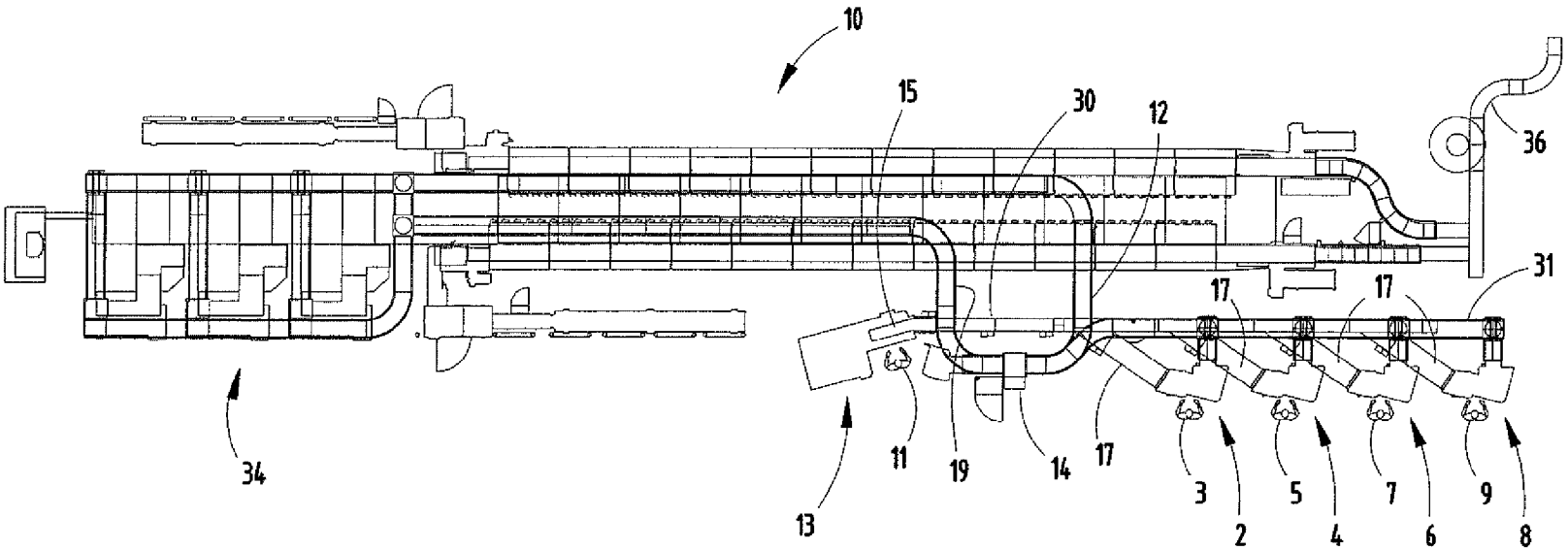

The unbundling system 100 (FIG. 1) of this invention can be integrated with an automatic processing system (shown in FIGS. 15A-15E), which is typically located at a postal distribution center. The processing system includes an automatic induction system 34 (FIGS. 15C and 15E) and an automatic flat mail sorter 10 (FIGS. 15D and 15E) employed for sorting of flat mail, such as catalogs, magazines, brochures, and the like. These materials are received from a printer/publisher in bundles (or packages) and which may be wrapped with a polymeric or other film or wrapping material and/or banded. FIGS. 15A-15D are individual sections of the system shown overlaid in FIG. 15E. The articles within the bundles are presorted according to zip code and/or address and/or mail route. The bundled flat mail is received by trucks in bulk amounts, frequently in palleted boxes. These flat mail bundles are removed manually and placed on conveyors 32 (FIG. 15A) for subsequent processing. The processing includes removing the outer wrapper and/or bands and sorting the unwrapped articles for delivery by carriers according to the addresses encoded on the magazines/catalogs by the printer and/or sequentially within the carrier's route. Part of the overall process of organizing such material for delivery to homes and businesses is the unbundling of the bundles during the overall process. Typically, operators 3, 5, 7, and 9 utilizing knives accomplish this task manually, which subjects the operators to potential injury as well as carpal tunnel syndrome in addition to inherent processing inefficiencies. The system of the present invention preferably is integrated into the automatic induction system to eliminate the manual cutting of bundle straps and/or wrap, and greatly speed up the overall process.

The flat mail preparation area 12 (FIG. 15C) of an automatic induction system 34 receives a palleted box of bundles from a publisher/printer which is placed into a tilt unit and tilted for ease of unloading. Bundles frequently will be numerous magazines and/or catalogs destined for particular areas of a city and are typically bundled according to zip code, street addresses, and the like. The incoming bundles may be wrapped, typically with a polymeric film, and/or may be banded with two or more orthogonal bands to firmly hold the stack of articles together. The bands, if present, may be internal or external to the wrapping. Also, some bundles may include individually wrapped articles, such as magazines or catalogs, with a stack of such articles banded into a bundle. Different modes of operation of the system of this invention address these different types of bundles.

An operator 11 (FIGS. 15A-15C) at the loading station 13 manually unloads bundles from the tilted box and places them individually onto a load conveyor 15. In conventional systems, the bundles are transported via incline conveyor 30, conveyor 31 and decline spur conveyors 32 to manual processing stations 2, 4, 6, and 8 where, in the prior art, operators 3, 5, 7, and 9 manually cut the wrap and/or bands and remove the remnants of same from the bundle in a manual debundling process. These operators next manually align the spines of the articles and stack them into empty "buckets". When the "buckets" are full, they are conveyed by conveyors 17 to elevator 14 then to the automatic induction section 34 (FIG. 15C) of the flat mail sorting machine 10 (FIGS. 15D and 15E) by conveyor 18. The buckets are automatically emptied in station 34 and then returned to the manual processing stations via conveyor 19. The unbundled packages are sorted in sorting stations 10 (FIGS. 15D and 15E) and outputted by conveyor 36 for subsequent delivery.

The package unbundling system 100 of the present invention can be integrated into the mail preparation area 12 of such an automatic induction system 34 in areas where the manual processing stations exist (such as decline spur conveyors 32) or other convenient locations in the area of incline conveyor 30. The system of the present invention, therefore, eliminates the manual cutting steps and can reduce the required quantity of package unbundling stations to one. The number of required operators is reduced, since each operator's workload is diminished because the cutting task is removed, therefore each operator can process more articles per unit of time. Thus, the system of the present invention can be integrated into an automatic induction system to greatly improve the efficiency of the overall operation of such a system as well as preventing injury to operators. The induction system 34 briefly described above is described in greater detail in U.S. Pat. No. 7,195,236, which issued Mar. 27, 2007, including, in particular, FIGS. 10A-10B thereof. The '236 patent is incorporated herein by reference.

Figure 1:
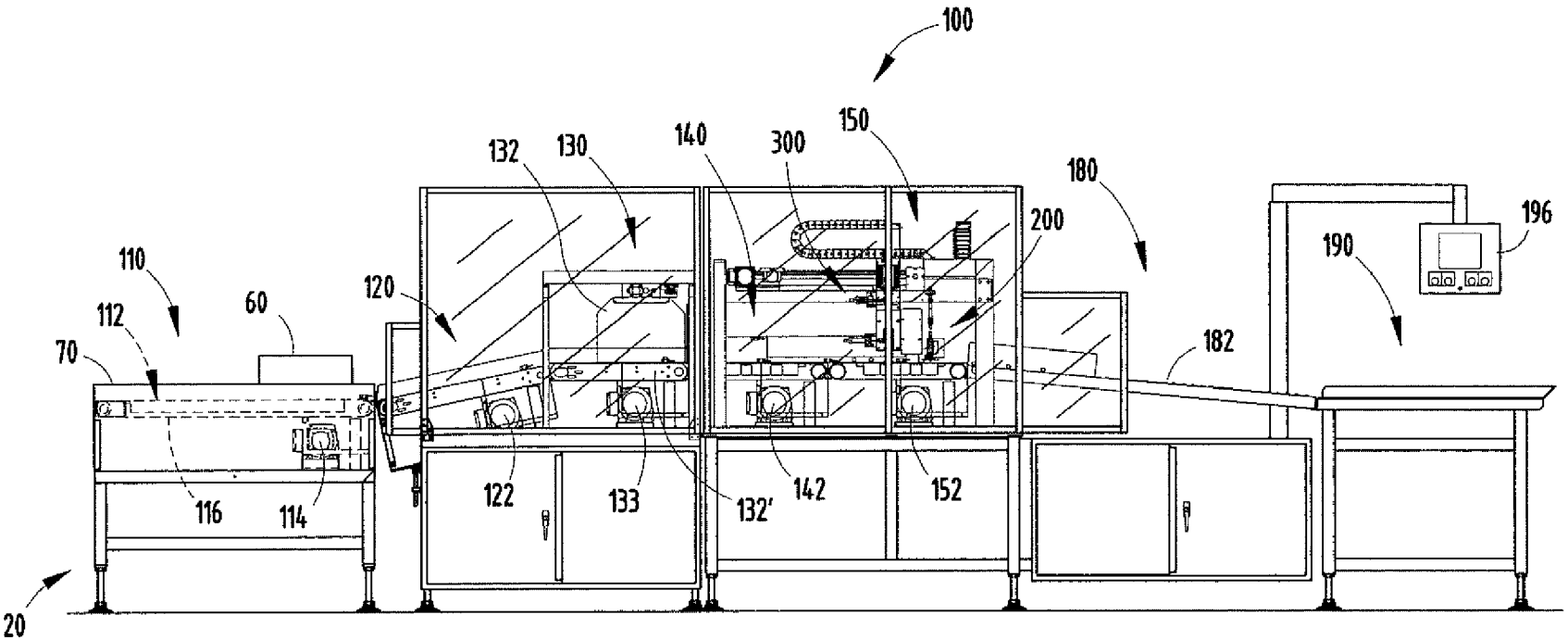
FIG. 1 is a front elevational view of a package unbundling system of the present invention.
Figure 2:
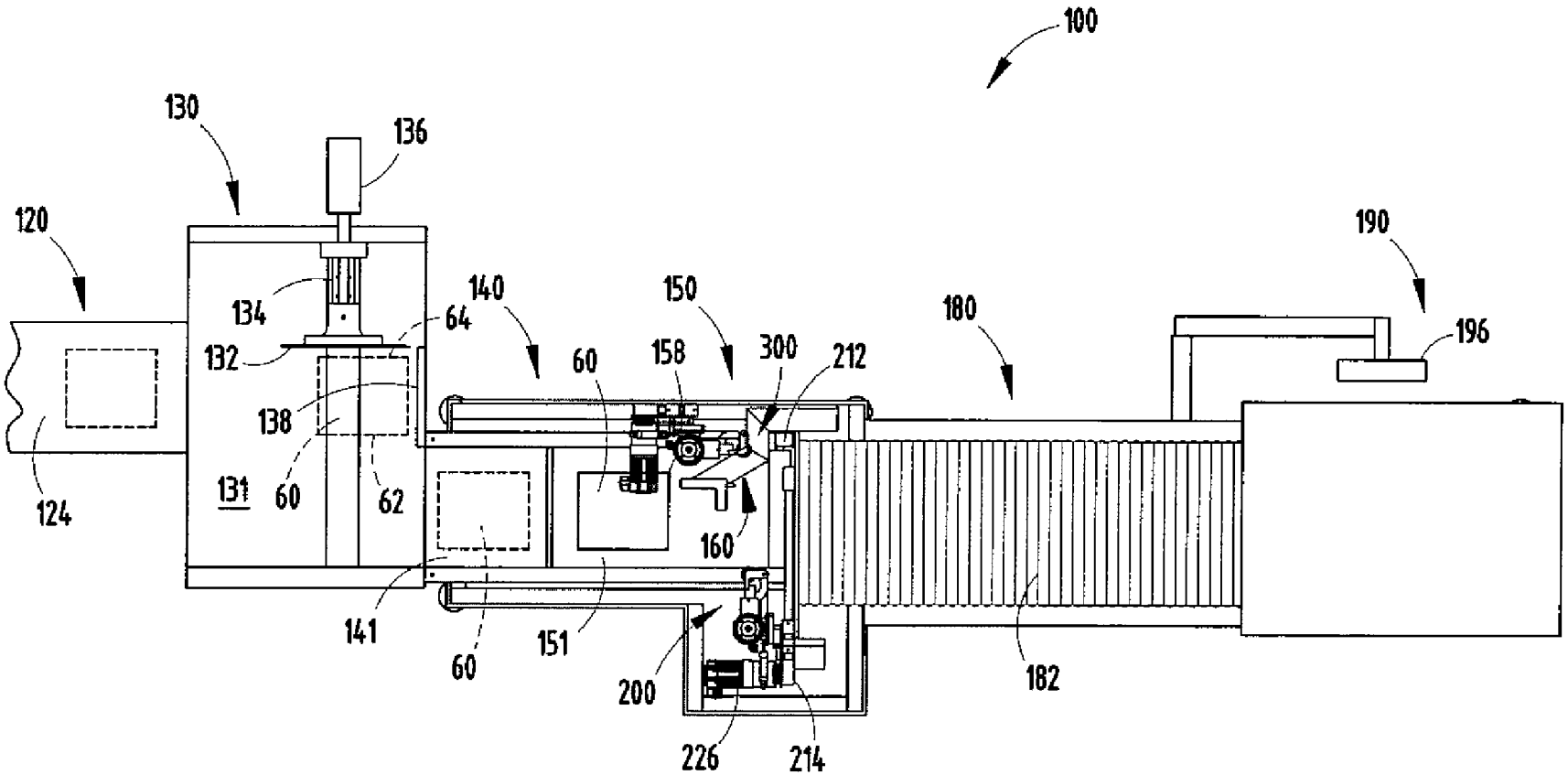
FIG. 2 is a top fragmentary plan view of the package unbundling system shown in FIG. 2.
Figure 3:
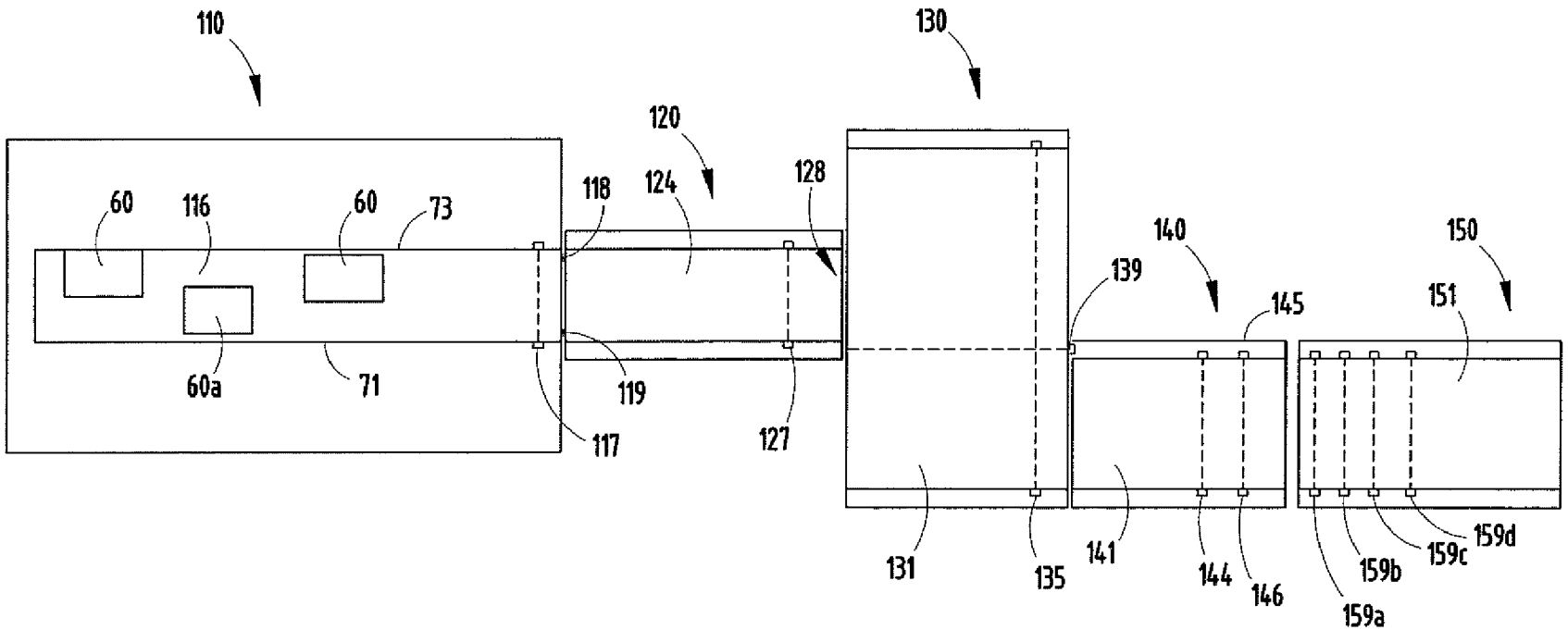
FIG. 3 is a top plan schematic view of the input conveyor and bundle handling system showing the various detectors employed for controlling the movement and processing bulk flat bundles of mail and inputting them into the unbundling station.

The package unbundling system 100 of the present invention is shown in FIGS. 1 and 2. The system, as shown in FIGS. 1 and 2, is a freestanding, manually loaded and unloaded machine, suitable for postal distribution centers that do or do not have an automatic induction system of feed conveyors. The system, when integrated with an automatic induction system, would not have the manual load component 110 and manual unload components 180, 190, and would need only stations 120, 130, 140, 150 and control system 196. The system 100 shown in FIGS. 1 and 2 has several sections, including a loading station 110 in which the operator places bundled packages for subsequent delivery to an inclined in-feed conveyor 120. Loading station 110 includes a load conveyor 112 (FIG. 1) which is a conventional, belt-driven motorized conveyor having a drive motor 114 and an endless loop belt 116. In one embodiment the conveyer speed was about 60 FPM (feet per minute). Packages or bundles 60 are manually positioned on the conveyer belt 116 by an operator depending upon the type of packaging used. If the bundles have only bands and no film wrap they are position adjacent at the near side rail 71 (FIGS. 1 and 3) of conveyer 112 as shown by bundles 60*a* in FIG. 3. If the bundle has a film wrapping with or without banding the bundle 60 is placed adjacent the far side rail 73 (FIG. 3). A photo sensor 117 (FIG. 3) indicates when the leading edge of a bundle has reached the exit end 118 of conveyor 112 and stops movement of conveyor belt 116 until the incline conveyor 120 is clear of bundles. When incline conveyor 120 is clear, if a bundle 60 or 60*a* is present at the end of in-feed conveyor 112, in-feed conveyor 112 will start, transferring one bundle to incline conveyor 120. Conveyor 112 also has a detector, such as a photo detector 119 (FIG. 3) at its exit end that determines, during a bundle transfer to conveyor 120, if the load operator has placed that bundle 60 against the near side guide 71. This information is inputted into the logic controller 196 and remains in a tag file associated with that particular bundle as the bundle travels through the system to be used later.

The incline conveyor 120 serves as a gapping conveyor running at a speed of 90 FPM in one embodiment to provide gaps between bundles from the in-feed conveyor 112. Conveyor 120 likewise has an endless loop belt 124 driven by motor 122 and includes an optical detector 127 (FIG. 3) that detects the presence of a bundle near the discharge end 128 of conveyor 120. Conveyor 120 (and all subsequent conveyors) runs faster than conveyor 112, creating a gap behind bundles 60 60*a* as they leave conveyor 112. Signals from the photo detector 119 are employed by circuit 196 to stop the load conveyor 112 after a bundle 60 has transferred to the incline conveyor 120, which is especially important if bundles 60 are packed tightly together on conveyor 112.

The package unbundling system 100 is designed to operate in two different modes depending upon the positioning of the bundle on load conveyor either against rail 71 or the opposite rail 73 (FIG. 3) which, in turn, depends upon the type of packaging the operator sees in the load station 110. Thus, bundles may include a single wrapping and internal or external banding in which case the bundle is placed against the far rail 73 (FIG. 3) and is not detected by photo detector 119, which detects the area immediately adjacent near rail 71. If, on the other hand, bundles are only banded and not overwrapped or include individually wrapped magazines or catalogs which, in turn, are banded together, it is desired only to cut the bands. In this case, the operator places the banded only bundles against near rail 71. As they reach detector 119, the mode of operation is detected and the control system for debanding system 100 automatically determines the desired mode of operation for a given bundle type. Thus, the machine either cuts the bands only or cuts the overwrap and band(s). This determination allows the cutter assemblies to operate faster when only cutting bands thereby speeding up the throughput of the system.

Bundles are then inducted by conveyor 120 into the bundle alignment and measurement station 130, which includes a laterally movable push plate 132, as seen in FIGS. 1-2 mounted on a movable cylinder rod 134 controlled by a pneumatic cylinder 136. Station 130 includes a stop plate 138 (FIG. 2) against which a bundle 60 is sequentially aligned and positioned, as seen in phantom in FIG. 2, when moved into the station 130 by the conveyor belt 131 controlled by motor 133 (FIG. 1). In one embodiment the conveyor belt 131 ran at about 120 FPM to move bundles into and out of the station. An optical beam is directed through an aperture 132' (FIG. 1) in plate 132 and impinges upon a photo detector 135 (FIG. 3) to detect the presence of a bundle moving toward backing plate 138. When a bundle 60 or **60*a* is detected by photo detector 135, the conveyor speed is reduced to move and align the leading edge of a bundle against the backing plate 138 with a minimum of bounce back. Once a bundle is so positioned the conveyor 131 is stopped and the pusher plate 132 is actuated to move the bundle transversely for measurement and positioning. For such purpose a second photo optical detector 139 (FIG. 3) detects the leading edge of a bundle being transversely pushed by plate 132. As push plate 132 is actuated, the bundle is moved across the now stationary conveyor belt 131 and the leading edge 62 (FIG. 2) of the bundle is first detected by detector 139 followed by the trailing edge 64, which is adjacent pusher plate 132**.

Figure 14:
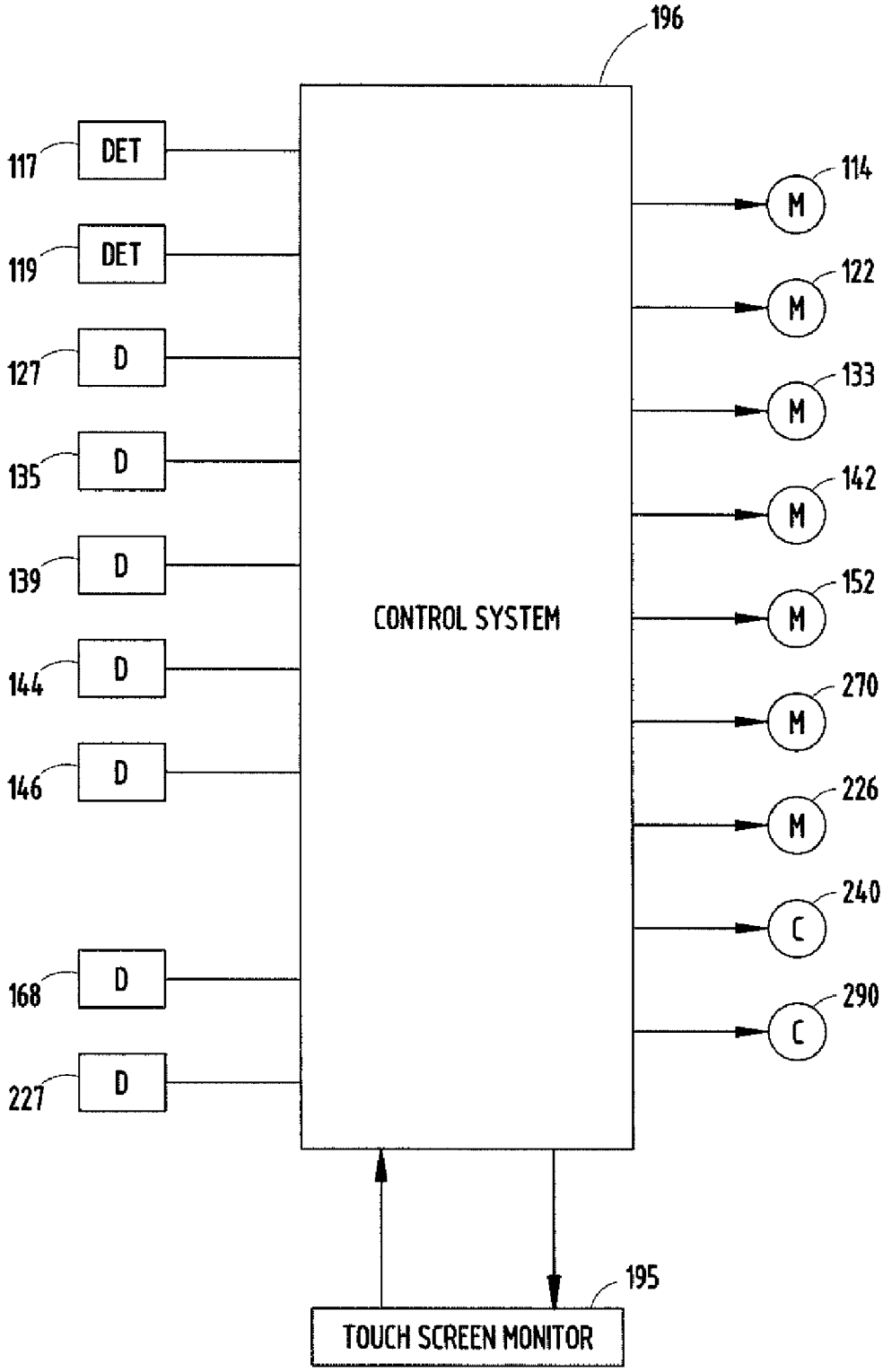
FIG. 14 is a block electrical diagram of the control system for the unbundling machine.

The cylinder 136 includes a linear analog position transducer to determine from the initial interruption of the leading edge 62 of the bundle by photo detector 139 and the trailing edge of plate 132 the distance traversed by the plate 132, which is only a part of the total move, in pushing bundle 60 laterally on the alignment station. By measuring the analog voltage output from the transducer at the time the leading edge of the bundle is detected and again at the time the plate 132 passes beyond the detector 139 and converting the difference in voltage to a distance and subtracting the known thickness of pusher plate 132, the width of the bundle 60 is determined. This width information is added to the tag file and follows the bundle to be used later by the control system 196 (FIG. 14) in positioning a bundle in the proper location in the unbundling station 150. When the cylinder 136 reaches its end of stroke, the bundle will be located with its trailing edge at a common position which centers the bundle in preparation for feeding to the staging station 140 (FIG. 2). During the next in-feed cycle of the alignment station 130, the now edge justified bundle 60 is transferred to staging station 140.

In some instances, the edge of a tightly wrapped bundle breaks the beam of photo detector 139. It is also possible that shards or wads of loose overwrap material or straps attached to a poorly wrapped or damaged bundle may momentarily break the beam. If the latter occurs, the bundle width will be erroneously reported as larger than it really is. This could lead to the cutting shoe in the bundle-opening or processing station 150 landing in the wrong spot or missing the bundle edge entirely.

Also the bundle may be shingled and present a parallelogram shape (in top plan view) rather than rectangular. This can lead to a gap between the bundle and the pusher plate 132 that may be seen by the measuring photo-detector 139. In order to prevent erroneous measurements, software techniques determine the "real" edge of the bundles.

The minimum bundle width is known. When the first beam break occurs at detector 139, the analog voltage value of the linear transducer associated with pusher rod 134 is measured and saved. When the beam makes again, the voltage from the linear transducer is again measured. If the difference between the two values represents a travel distance of less than the known minimum bundle width, the bundle width value is discarded and the system waits for the next beam-break in order to start the measuring process again. Typically, this will eliminate measuring errors caused by loose straps or overwrap that momentarily blocks the detector's beam.

As the trailing edge of the bundle is pushed through the measuring detector 139, the beam may make momentarily if a gap exists between the bundle and the pusher plate 132. This momentary making of the optical beam represents the trailing edge of the bundle. If this happens, there will be another very short break in the beam as the pusher plate thickness (approximately ¼ inch) passes through the beam. The making of the beam is registered by the computer within the control system 196 whether followed by another break or not, as the trailing edge of the bundle, and the bundle width is calculated accordingly.

After a sequence of beam breaking and making that represents a valid bundle width, the remainder of the push cycle is monitored to see if another beam break occurs. If, at the end of the pusher's stroke, another beam break has not occurred, the ¼ inch thickness (of the pusher plate 132) is subtracted from the bundle width to determine the actual bundle width measurement. If another beam break does occur, the bundle width measurement is used as is, since the measurement did not include the pusher plate thickness.

As seen in FIG. 2, a bundle 60 is edge justified on belt 131 of alignment measuring station 130 and drive belt 131 of alignment measuring station 130 is again actuated to move bundle 60 onto conveyor 141. The staging station 140 includes side rails 145 (FIG. 3), with a first photo detector 144 which, when the bundle interrupts the optical beam, decelerates and temporarily stops the conveyor belt 141 with a bundle in the path of a height measuring photo detector 146. Detector 146 is positioned approximately 4½" from the surface of conveyor 141 to provide a signal indicative of the height of a bundle being processed as being either greater or less than 4½". This information is attached to the tag file and is subsequently employed to control a vertical clamp 160 (discussed below in connection with the description of the processing station 150). Endless loop conveyor belt 141 is driven at a speed of about 120 FPM by a drive motor 142 (FIG. 2) to move bundles in a singulated manner from the staging station 140 onto a conveyor belt 151 of processing station 150, as shown in FIGS. 1-3.

Belt 151 is driven by a servomotor 152 equipped with a distance measuring encoder, which is operated to sequence a bundle 60 into the processing station, position it in place during the cutting steps shown in FIGS. 12A-12E and 13A-13D, and subsequently discharge the bundle onto unloading station 180.

The processing station 150 also includes a series of photo detectors 159*a*-159*d* (FIG. 3) that employ optical beams to detect the longitudinal leading edge of the bundle 60 as it is conveyed into the processing station 150. When both photo detectors 159*c* and 159*d* are blocked by the leading edge of bundle 60, it causes servomotor 152 to instantly change from a continuous jog mode to perform a programmed move to a specific known location. This move positions the leading edge of bundle 60 at a precise location in station 150. Since the bundle was previously positioned laterally in alignment station 130, the bundle is now corner justified 158, as seen in FIG. 2.

The length and position of a bundle is measured as it is transferred from station 140 by two conveyors 141 and 151 into the bundle opening station 150. During this transfer cycle, four photo detectors 159*a*-159*d* are used to find the leading and trailing edges of the bundle. These detectors are located in bundle opening station 150 as seen in FIG. 3. The leading-edge final registration detector 159*d* is about 4 inches ahead of the final stopping position of the bundle. The leading-edge pre-registration detector 159*c* is about 7 inches ahead of the final stopping position of the bundle; the gating detector 159*b* is 10 inches ahead of the final stopping position, while the trailing-edge detector 159*a* is 14 inches ahead of the final stopping position of the bundle. The trailing-edge detector is located between the staging station 140 and opening station 150 conveyors where offal is typically not present.

The height-qualifying detector 146 is located in staging station 140 about 11 inches ahead of the stopping position of the bundle at the bundle opening station. (This identifies, as noted above, bundles over 5 inches tall, causing the clamp 160 in the opening station to open further than 6 inches only when necessary for tall bundles, saving cycle time.) Detector 146 is only active if a bundle is blocking the deceleration detector 144 in the staging station 140 (about 1 inch downstream of the height-qualifying detector).

As the bundle is conveyed between stations 140 and 150, the leading-edge final registration detector's beam (159*d*) is broken. The servomotor 152 notes the position the bundle's leading edge is at when the beam is broken and drives the conveyor 151 a fixed distance to position the bundle correctly for opening. (This is called a registration move.) Also, the position of the servomotor is noted when the trailing-edge beam is made as detected by detector 159*a* after the bundle has passed through. This data is used by control system 196 to calculate the bundle length.

Since, during the length measurement, the conveyor direction of travel is the same as the bundle direction of travel, it is possible to have various types of offal from the opening process become stuck to the conveyor belt surface and block the optical beams momentarily. This can result in mispositioning of the bundle, bundle length miscalculation, or other sequencing problems. In addition, loose packaging materials can create erroneous length measurements. In order to eliminate such errors, the sequence of interruption of the optical beams as detected by detectors 159*a*-159*d* is monitored.

The minimum length of a bundle is known. Most offal on the conveyor belt is small, typically less than 1 inch, which is much shorter than a bundle. Thus, as the bundle feeds forward, the control system looks for the breaking of the beam of the leading-edge final registration detector 159*a* only after the leading-edge pre-registration beam is broken and stays broken (this only occurs with an object greater than 3 inches in length). Also, both leading-edge registration detectors are "armed" or "gated" only after the trailing-edge beam has been newly broken. This eye was chosen over the gating eye because it is more likely to be "offal free". This identifies the most leading feature of the bundle, as in the width measuring station 130. This edge may be loose strapping or overwrap, rather than the actual bundle edge.

If the leading-edge final registration eye's beam remains blocked for the next inch of the servomotor's registration move, it is assumed that the edge previously detected is the leading edge of the bundle. If, however, the leading-edge final registration eye beam is made for any reason within the next inch of travel, it is assumed that the object detected was not the leading edge of the bundle, and the system will re-register on the next beam blockage of the final registration eye.

Next, the trailing-edge detector 159*a* is monitored for its beam to break, and then make. The trailing-edge detector's signal is only accepted if the gating eye's beam is recently blocked. The position of the bundle at the time the trailing-edge detector makes is used to calculate the bundle length.

As a processed bundle leaves the bundle opening station 1507 the gap between the trailing edge of that bundle and the new bundle being conveyed into station 150 is always greater than the 3 inch spacing of the leading-edge registration detector 159*d* to allow a new registration to occur.

Figure 9:
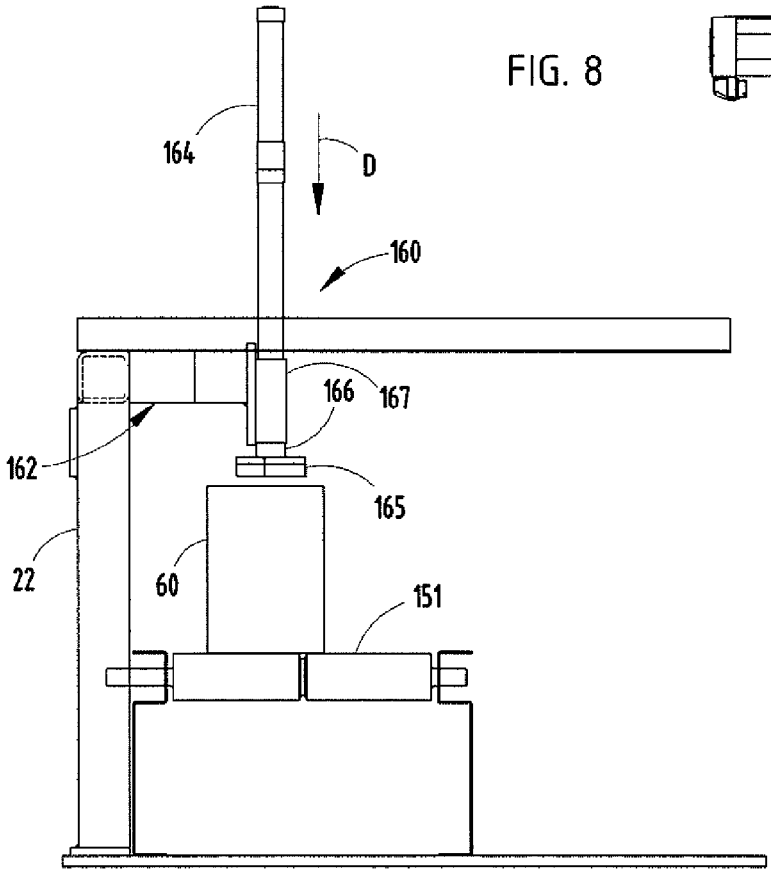
FIG. 9 is a left side elevational view of the mounting of the clamping assembly for holding a bundle in place in the unbundling station during processing.

The previously described registration move is employed to stop belt 151 with bundle 60 corner justified at 158 (FIG. 2) in station 150 under a vertically movable clamp 160 which, when bundle 60 is stationary and belt 151 is stopped, moves downwardly in the direction indicated by arrow D in FIG. 9 to hold the bundle firmly in position to allow first and second cutting stations 200 and 300, respectively, to process the bundle according to the desired sequence. This sequence may cut overwrap only, overwrap and bands, or bands only. Depending on whether a bundle is less or greater than 4½" in height, the clamp 160 retracts a lesser or greater amount between cycles to speed up the overall operation of the system.

Figure 8:
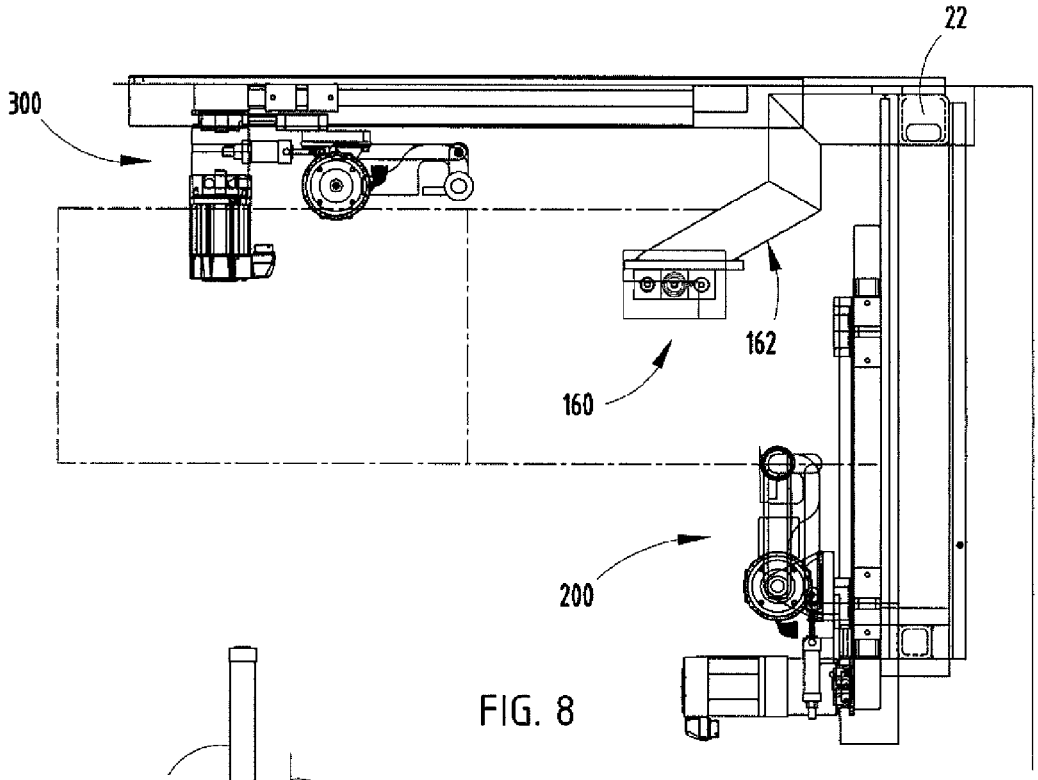
FIG. 8 is a top plan view of the unbundling station.
Figure 10:
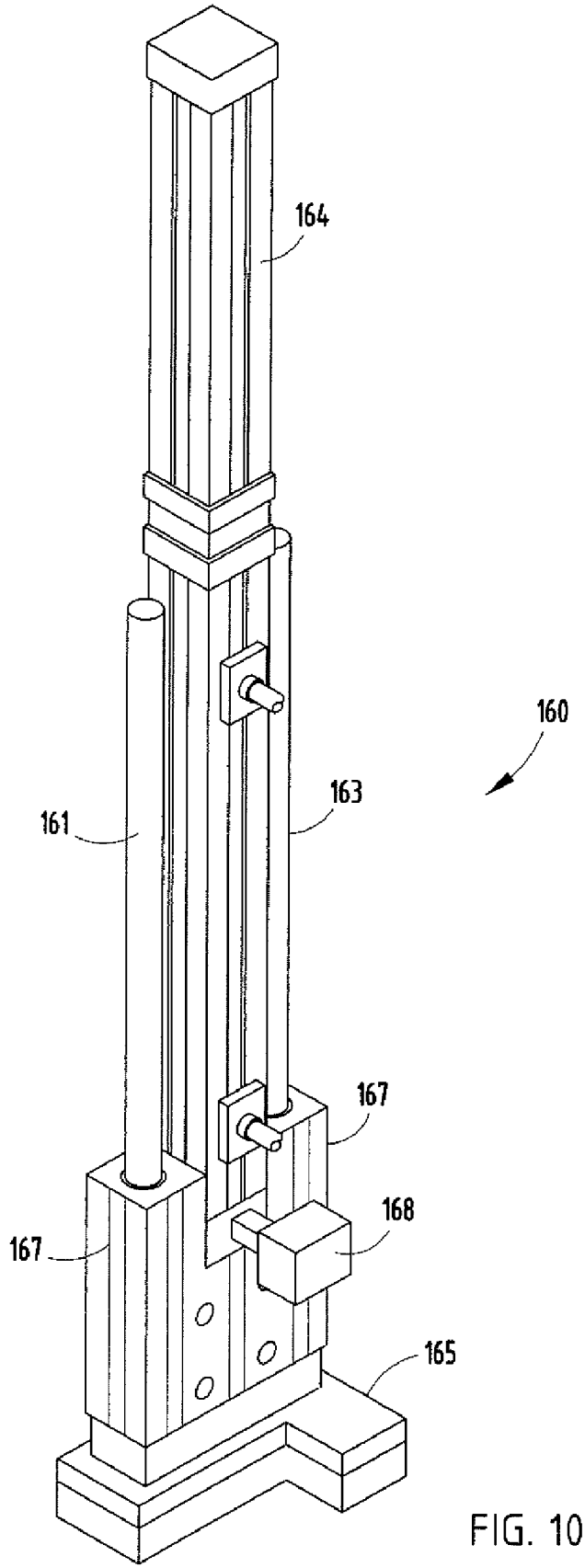
FIG. 10 is a fragmentary perspective view of the clamping assembly shown in FIG. 9.
Figure 11:
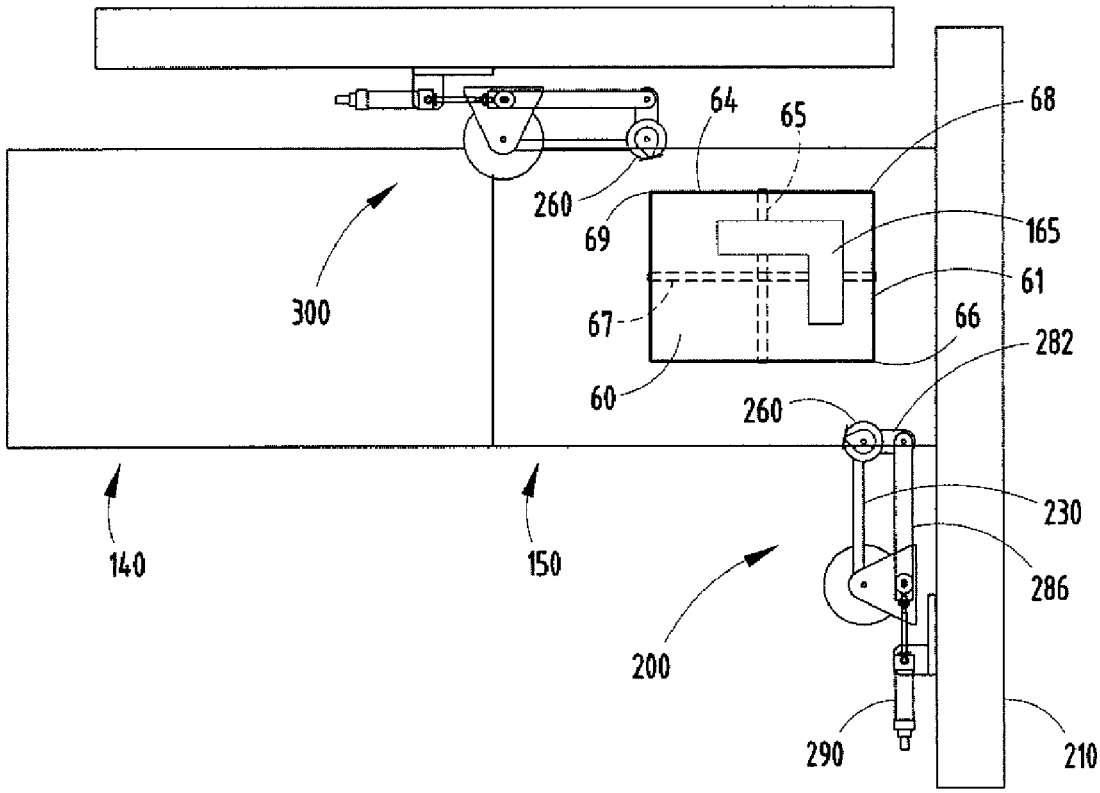
FIG. 11 is a top plan schematic view of a bundle in the unbundling station for processing.

Clamp assembly 160 is shown in FIGS. 8-10 and includes a mounting bracket 162 which attaches the clamp to a vertical support post 22 on the overall framework 20 (FIG. 1) supporting the components of machine 100. Clamp assembly 160 includes an actuator cylinder 164 with a piston rod 166 coupled to an L-shaped pad 165 which engages the leading edge of a bundle 60 and the edge near cutting station 300 as illustrated in FIG. 11. The L-shape of the pad 165, therefore, assists in holding the typically plastic wrap and bands near the leading and top edges of bundle 60 in place during the cutting and debanding operations. Pad 165 is coupled to a pair of cylindrical guide rods 161, 163 with bushings 167, which allow the L-shaped pad 165 to raise and lower to squarely engage a bundle 60.

When the clamp cylinder's forward motion ceases, pressure sensor 168 detects the bleed down of pressure in the rod end of the cylinder. When the pressure falls below about 5 psi, the sensor indicates a clamped state which is sufficient to secure the bundle for processing at cutting stations 200 and 300 in a sequence as described below. With the bundle 60 precisely positioned in station 150 and clamped in place by clamp 160, the cutting assemblies 200 and 300 are then actuated to cut the foil and/or banding from the bundles as now described.

Cutting assemblies 200 and 300 are substantially mirror image identical cutters which cut traversely across the leading edge 61 of bundle 60 and the side edge 64 of the bundle, while clamped in the processing station 150. In view of the fact that cutting stations 200 and 300 are substantially identical, only one station (200) is described in detail, it being understood the remaining cutting station 300 is sequentially actuated in synchronism with cutting station 200 to cut the overwrap and bands of the bundles 60. Although processing station 150 includes two cutting stations or assemblies 200 and 300 for cutting the leading edge 61 of bundle 60 as well as the side edge 64 (FIG. 11) to cut the wrapping and banding on adjacent sides, other arrangements including fewer or additional cutter assemblies could be mounted within station 150.

Figure 4:
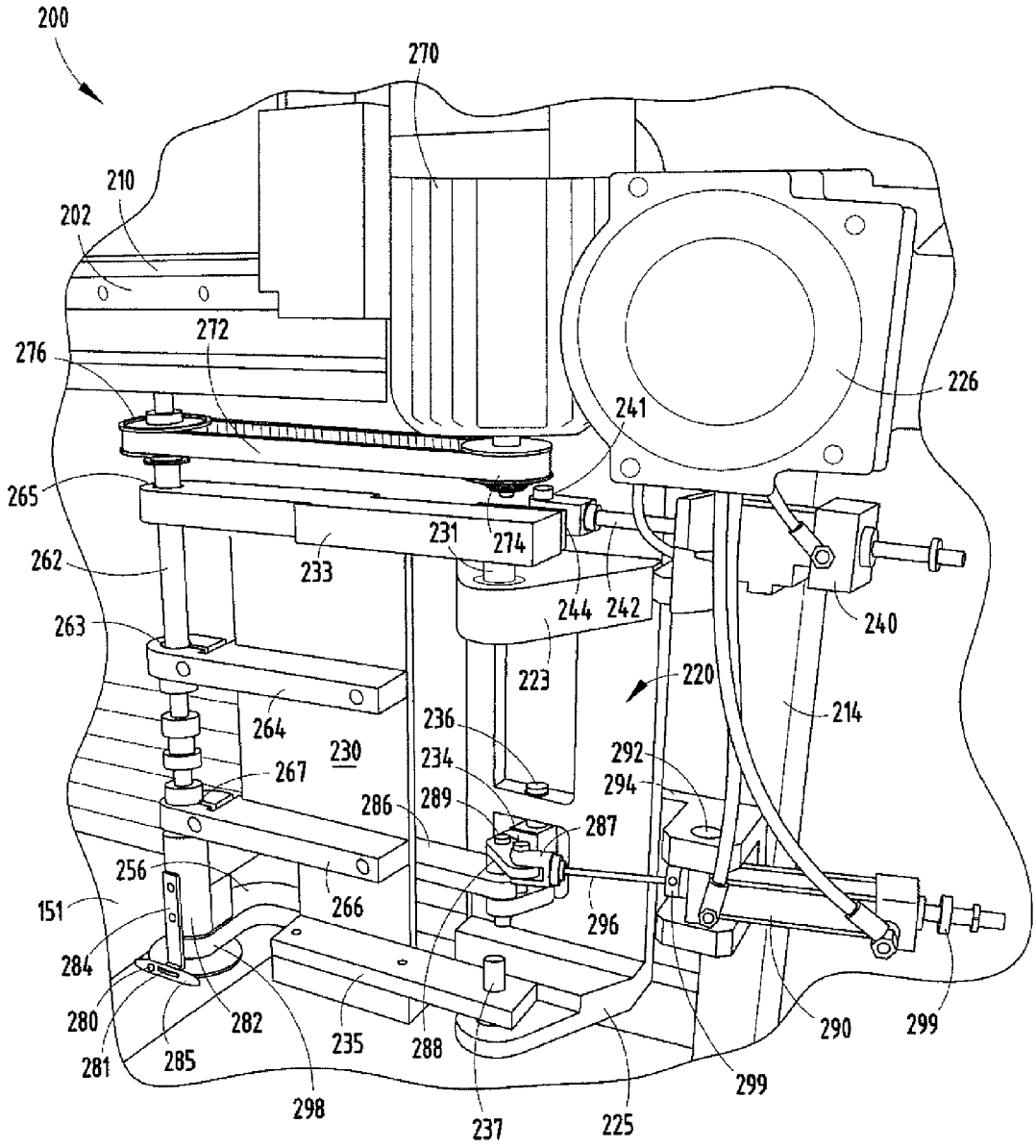
FIG. 4 is a perspective view of one of the cutter assemblies of the present invention.
Figure 5:
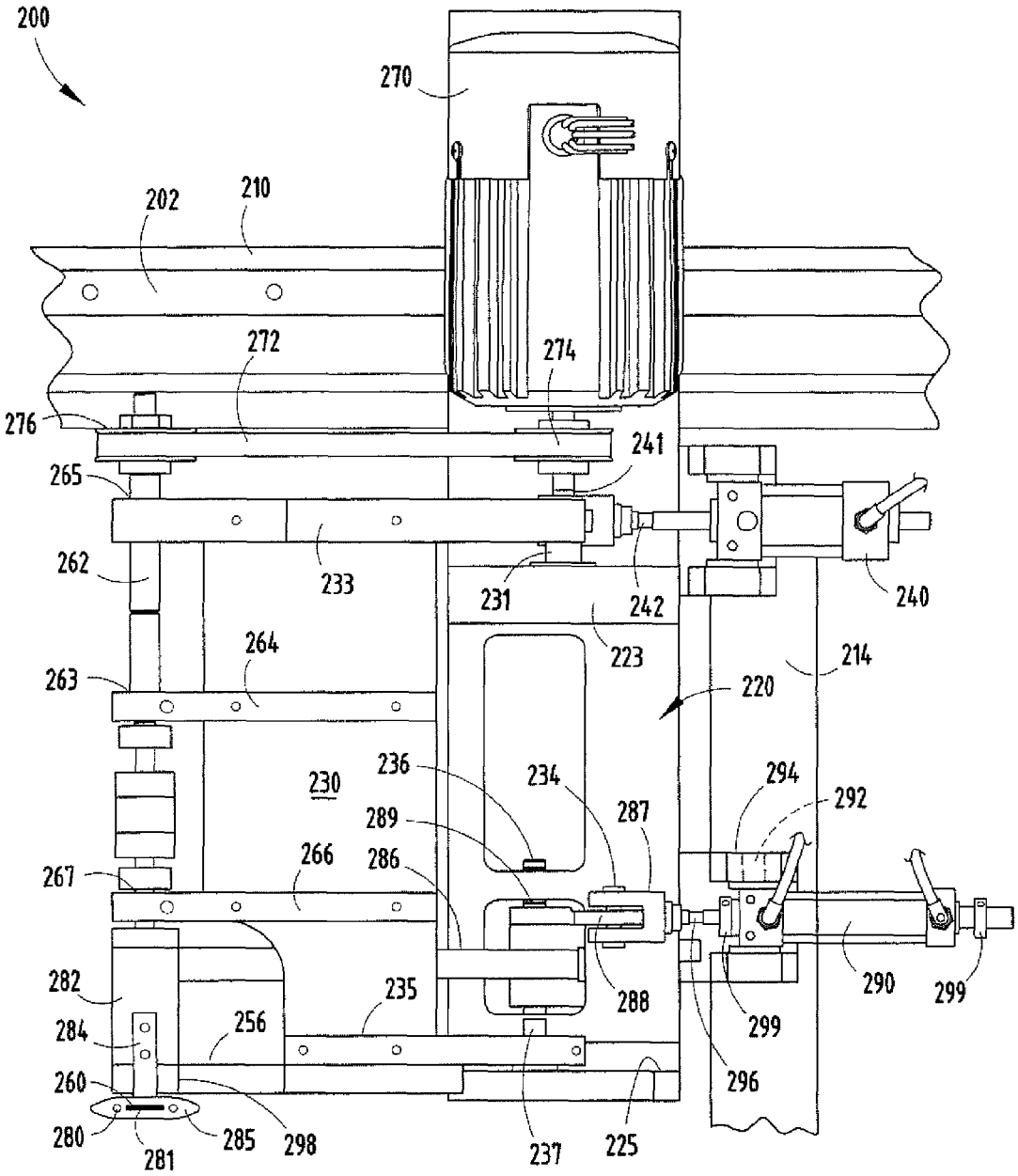
FIG. 5 is a front elevational view of the cutter assembly shown in FIG. 4.

Cutting station 200 is shown in detail in FIGS. 4-7 and includes a transverse stationary beam 210 extending laterally across the conveyor 151 and supported at opposite ends by vertical frame members 212 and 214 (FIG. 2) of the machine. Beam 210 includes a T-shaped drive track 202 (best seen in FIG. 7), which receives a roller bearing carriage 204 for sliding movement therealong. The carriage 204 is coupled to a movable support plate 220 (FIG. 7) which is driven by a drive belt 224 coupled to clamp 222, in turn, coupled to plate 220 by a bracket 221. Drive belt 224 is driven by servomotor 226 (FIGS. 2 and 4) through a gear box (not shown). Belt 224 travels around the top of beam 210 and within the interior of the beam to move plate 220 and the pivoted members mounted thereto, including the cutter element as described below, across the front edge 61 of bundle 60 in a programmed sequence depending upon which of the two modes is being run. Plate 220 includes an upper pivot mounting boss 223 (FIG. 5) and a lower pivot mounting boss 225 for pivotally mounting a pivoted carriage 230 by an upper pivot arm 233 and a lower pivot arm 235 through pivot pins 231 and 237, as seen in FIGS. 4 and 5.

Carriage 230 is pivoted by a cylinder 240 (FIGS. 4 and 5) having a cylinder rod 242 coupled to arm 233 by a pivot connection 241 and an offset arm 244 (FIG. 4). Carriage 230 supports a rotary cutting wheel 260, which is mounted on vertically rotatable shaft 262 supported by bearings 263 in support arm 264 and bearings 265 at the end of arm 233. Cutting wheel 260 is driven by drive motor 270 through drive belt 272 and pulleys 274 and 276 to rotate cutter wheel 260. A mounting bracket 284 attaches piercing shoe 280 (FIGS. 4 and 5) to a pivotable collar 282 which surrounds drive shaft 262 and includes suitable bearings. Collar 282 is pivotally coupled by link bar 286 to pivot arms 234, 288, which is moved by actuating cylinder 290 pivotally mounted to support plate 220 by pivot pin 292 and mounting arm 294 (FIGS. 4 and 5). The rod 296 of cylinder 290 is pivotally coupled to the end of pivot arms 234, 288 remote from collar 282 by means of a link bar 286, pivot pin 289, and an interconnecting clevis 287.

Actuation of cylinder 290, thus, pivots collar 282 and the shoe 280 mounted thereto, while cylinder 240 pivots the entire carriage 230 toward and away from a bundle 60. Shoe 280 may include a slot 281 into which the edge of cutter wheel 260 extends. Instead of a slot, the shoe may include a recess, such as a trough, to provide clearance for the cutter wheel 260. Shoe 280 also includes curved tips 283, 285 at opposite ends for piercing the wrap of bundle 60, lifting the wrap away from the bundle, and guiding it into the nip point between the shoe and the cutter wheel 260. One mode of operation is disclosed in conjunction with FIGS. 12A-12E below. The combination of carriage 230, swing arms 233/235, the pivotable collar 282, the link bar 286, pivot arm 234, 288, and their associated pivot points define a classic four bar linkage, the purpose of which is to maintain the piercing shoe angle relative to the bundle at the proper value (which is established by the amount of extension and retraction of cylinder 290, which is in turn controlled by the location of stop collars 299) regardless of the swing of carriage 230. This allows carriage 230 to swing until it contacts the leading edge 61 of bundle 60, while maintaining the shoe angle at the optimum value for piercing or gliding through the wrap.

Figure 6:
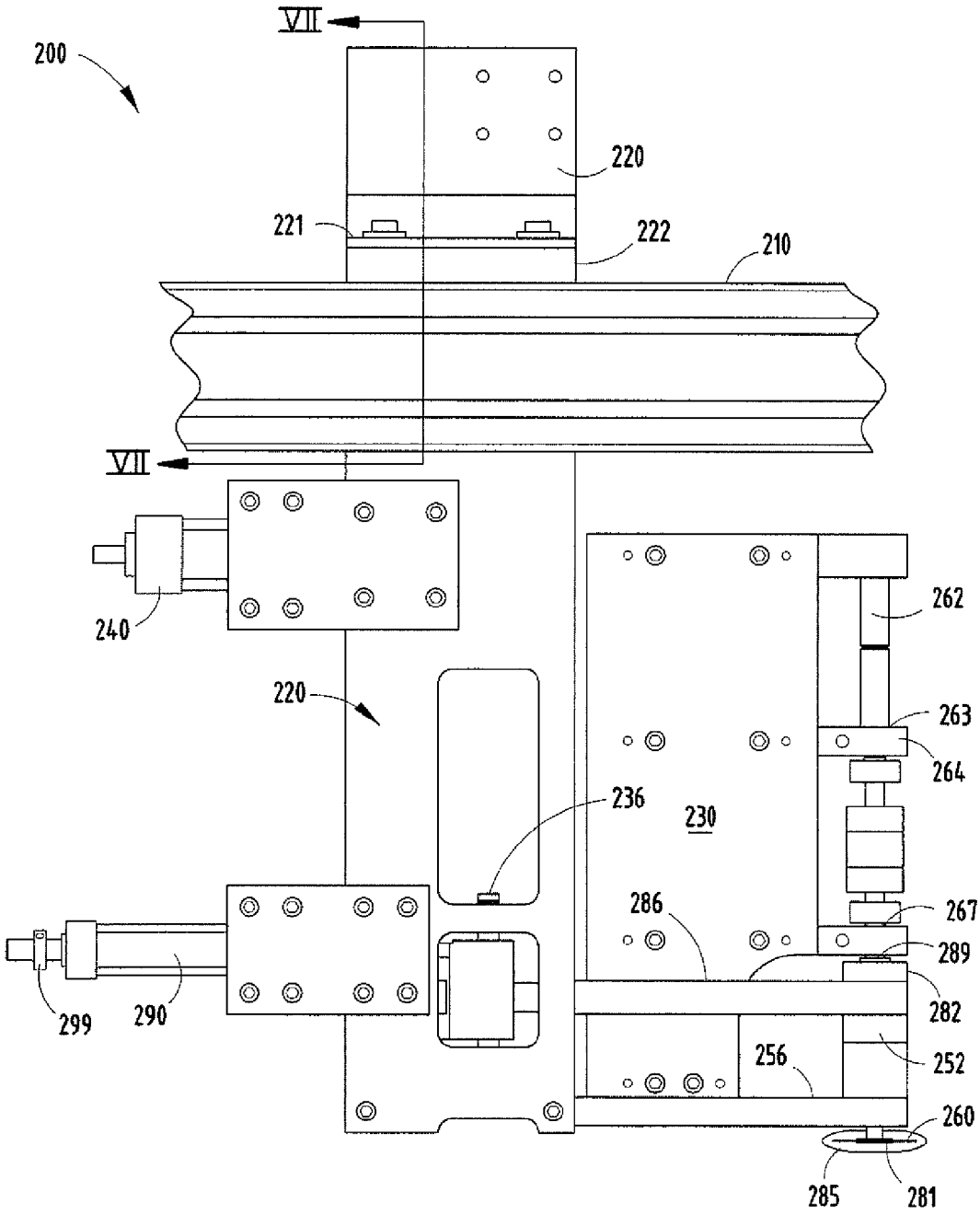
FIG. 6 is a rear elevational view of the cutter assembly show in FIG. 5.
Figure 7:
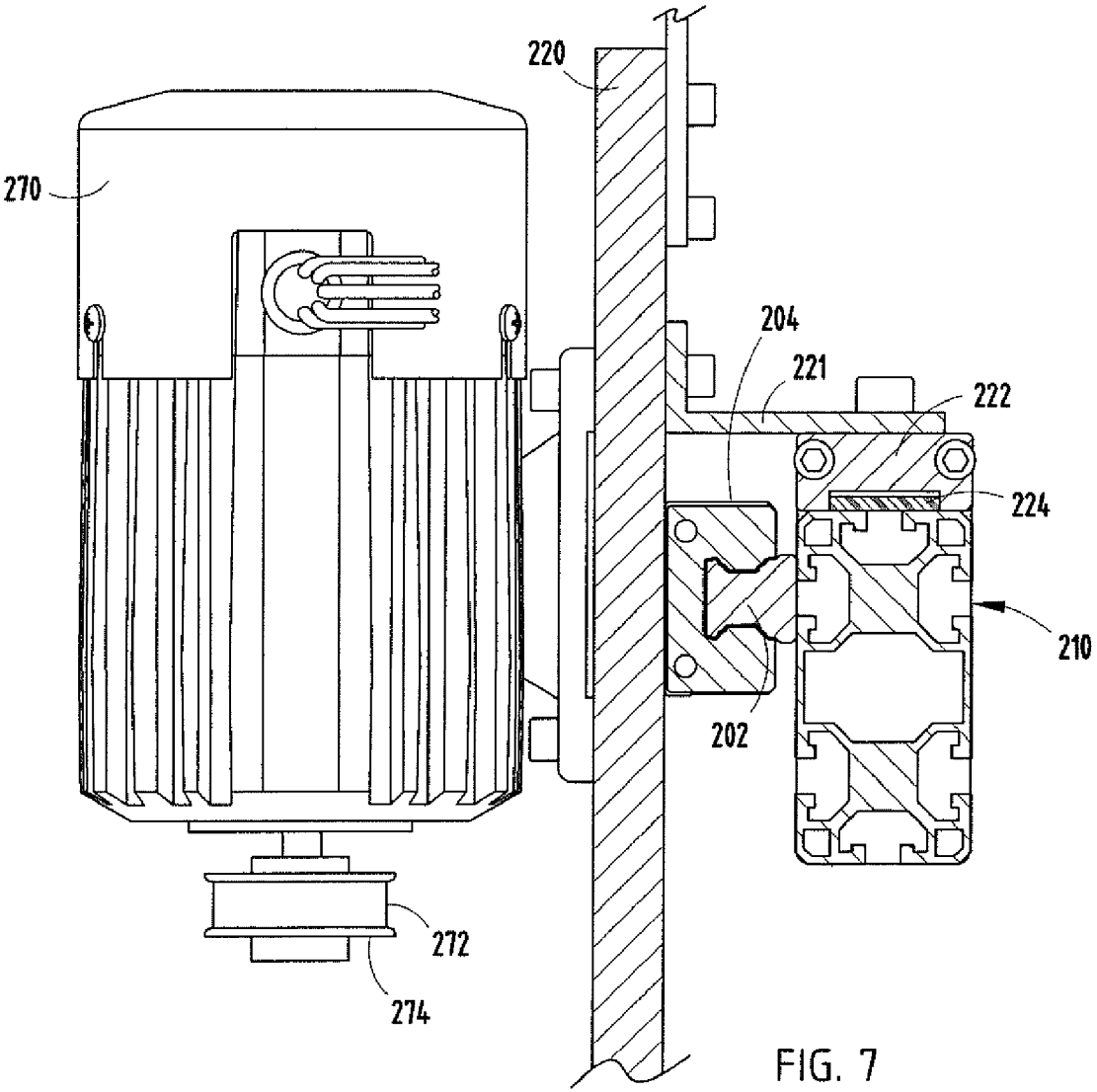
FIG. 7 is a fragmentary vertical cross-sectional view of the cutter assembly support beam shown in FIGS. 4-6 taken along section line VII-VII in FIG. 6.

Arm 286 coupled to collar 282 is also pivotally mounted to plate 220 by cross arm 234 and pivot pin 236 (FIGS. 4 and 5). Collar 282, as best seen in FIG. 6, is pivotally mounted to the opposite end of arm 286 by pivot connection 289 which extends through an aperture in arm 286 and offset arms 251 and 252 coupled to collar 282. The drive shaft 262 is also supported by second and third cross plates 266 and 256 and bearings 267 and 298 (FIGS. 4 and 5). The third cross plate 256 is secured to the bottom of carriage 230 and also supports the lower end of collar 282 in rotatable engagement therewith. Collar 282 includes a suitable bearings or bushings in order that it may pivot coaxially with the rotating vertical drive shaft 262.

Thus, carriage 230, link bar 286, pivotable collar 282, and pivot arms 234, 288 form a four bar link with respect to the pivoted motion of cutter 260 which is moved toward and away from the leading edge 61 of bundle 60, as shown in the FIG. 12 sequence of operation. The actuation of cylinder 290 tilts shoe 280 into either a neutral or a tilted-in position to initially cut into the wrapping of bundle 60. The sequence of operation of cutter wheel 260 and shoe 280 is shown in FIG. 12 for the mode of operation where wrapping and bands are being cut on a bundle. The width and length of the bundle is known as previously determined in the alignment station and during feeding to station 150. The location of the bundle is also known in the processing station, and, therefore, a rotary encoder 227 on the servomotor 226 which drives the carriage drive belt 224 can be used to determine the desired position of the cutter wheel 260 with respect to the bundle. This determines the exact position of the cutter wheel 260 with respect to bundle 60. A similar control is employed to position the cutter wheel of cutting assembly 300 with the side of a bundle 60.

In FIG. 12A, cutter assembly 200 is shown in the home position (H) at the initiation of the cycle. Cylinder 290 is actuated to move the now clockwise rotating wheel 260 and shoe 280 to position A, as shown in phantom in FIG. 12A. FIG. 12A illustrates the alignment of cutter wheel 260 in position A approximately 1" in from the right front corner 66 (as viewed from above) of bundle 60. The cutter shoe 280 is tilted inwardly at an acute angle of from about 5° to about 10° with respect to edge 61 with the apex of the angle toward corner 66. FIG. 12B indicates the pivoting of the carriage 230 inwardly toward the bundle through the actuation of cylinder 240 (FIGS. 4 and 5). The pressure applied to cylinder 240 is regulated to pivot carriage 230 with shoe 280 against bundle 60 at a force of from about 10 lbs. to about 20 lbs. As shown in phantom in FIG. 12B, the carriage 230 is then drawn to the right toward corner 66 of bundle 60 to pierce the wrap, cut the wrap during travel, and tear open corner 66 of the bundle through the action of cutting shoe edge 285 (FIG. 5) piercing the wrapping and the cutting of the wrapping by wheel 260. As shown by FIG. 12C, carriage 230 is then moved to the home position H away from the bundle 60 and simultaneously to position A with wheel 260 now reversed. The carriage 230 is again advanced with shoe 280 moved into the slit previously cut into the bundle. This combination of carriage retraction and leftward movement helps clear any wrap still attached to the cutter shoe 280 that may not have torn fully away. During the actions shown in FIGS. 12C and 12E, the cutter rotation is reversed (now counterclockwise rotation as seen from above), and the cutter shoe 280 is pivoted to a neutral or parallel position with respect to bundle edge 61. As indicated by FIG. 12D, the cutter is then advanced across the forward edge 61 of bundle 60 while in all positions the clamp 160 is holding the bundle in place and belt 151 is stationary. The stroke across the front edge 61 of the bundle begins inside the previous slit and completes the cutting of the front edge 61 as well as the front left corner 68 of the bundle using the edge 288 of the cutting shoe opposite edge 285. The carriage 230 is then retracted to the end position E, as shown by FIG. 12D, and, simultaneously, the cutter assembly 200 is moved back toward the home position, as shown in FIG. 12E. This combination of carriage retraction and homeward movement helps clear any wrap still attached to the cutter shoe 280 that may not have torn fully away.

Cutter assembly 300 provides substantially the same sequence of operation, with its forwardly cutting approach to corner 68 slightly delayed so the cutting wheel 260 associated therewith does not interfere with the cutting wheel 260 of assembly 200. Thus, typically assembly 200 will run its sequence of operation, as shown in FIGS. 12A-12E. Simultaneously, cutter assembly 300 similarly advances toward 1" within the left rear corner 69 of bundle 60 perform a rearward moving piercing, cutting of side 64 (FIG. 11), and tearing out of the corner 69 and subsequently move away and back into the 1" slit formed by the initial reverse cut and then moved forwardly to cut edge 64 and finally corner 68 of bundle 60. The cutter and cutting shoe of assembly 300 sequence in rotation similarly to cutter assembly 200, but the direction of rotation of the cutter is reversed from cutter assembly 200. The cutting wheels are aligned such that the cuts made in the forward edge 61 and side edge 64 are substantially aligned to tear away corners 66, 68 and 69 and provide continuous slits in the covering on edges 61 and 64. Thus, upon completion of the sequence shown in FIGS. 12A-12E, the bundle wrap has been substantially opened on two sides and three corners and advances to the unloading station 180 (FIGS. 1 and 2). Any bands present are also cut. A gravity roller conveyor 182 transports the now substantially opened envelope of bundle 60 to a work station 190 where an operator can easily physically remove and discard the outer wrapping and bands then place the unbundled contents of the bundle into an awaiting cart for manual loading to a sorting system.

Figures 13A, 13B, 13C, 13D:
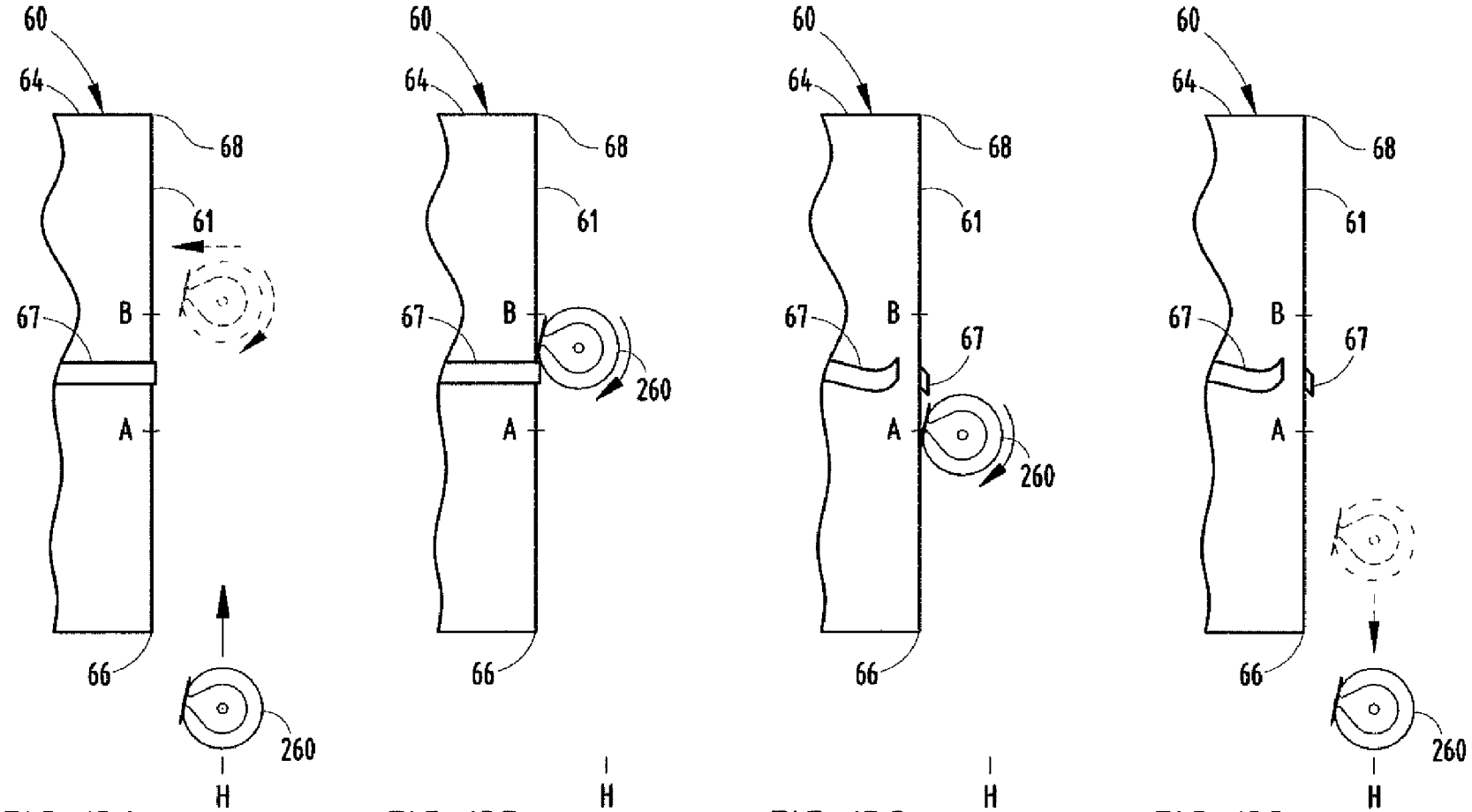
FIGS. 13A-13D are sequence plan schematic drawings of the operation of one of the cutter assemblies in cutting a band only of a banded bundle.

If the wrap cutting stroke along front edge 61 and side edge 64 of bundle 60 is unnecessary since either the bundles are only banded or individual magazines/catalogs are in individual poly bags and held together by outside banding, the band-only cutting sequence shown in FIGS. 13A-13D is employed to simplify and speed up the unbundling operation. In FIG. 13A again, the cutting assembly 200 is shown in the home position H. The assembly 200 moves toward the center of the conveyor 151 and is positioned stationary (from a lateral movement standpoint) with cutter wheel 260 located beyond strap 67 on bundle 60 toward corner 68 at position B, as shown in phantom form in FIG. 13A. The cutter is rotating in a clockwise direction as seen from above. In this position, cylinder 290 has been actuated to tilt edge 285 of cutting shoe 280 inwardly toward bundle 60 and the carriage 230 is swung inwardly by the actuation of cylinder 240 to advance the cutter shoe 280 into engagement with bundle 60, whereupon the assembly 200 is moved toward corner 66 across an area where band 67 is expected to be located, thereby catching and cutting the band 69 as the carriage 230 is retracted along beam 210 (FIG. 11) during the cutting stroke of FIG. 13C. In FIG. 13D, the carriage 230 is again retracted, moving the cutting wheel 260 away from bundle 60, and band 67 on bundle 60 has been cut and the assembly 200 is moved back to the home position H. Assembly 300 similarly operates in a similar sequence simultaneously in this mode of operation to cut the lateral band 65 (FIG. 11). This band cutting mode of operation provides a faster throughput for banded only bundles.

By providing the pivoted cutter shoe 280 and by pivoting with the cylinder 290 so the leading moving edge of the shoe initially tilts toward the wrap of the bundle, clean piercing of the wrapper for bundle 60 is assured. As the initial rearward cut is made, as shown by FIG. 12A, edge 285 of shoe 280 is tilted inwardly from about 5° to 10° and preferably 7° toward leading edge 61 of bundle 60 to assure that, as the carriage 230 traverses the cutting wheel 260 to the corner 66, and the corner is ripped out. As the subsequent forward transverse cut is made, as shown in FIGS. 12C and 12D, the shoe is moved to a neutral position by the actuation of cylinder 290 and, as edge 283 of shoe 280 enters the previously cut slit, any resistance to further advancing tends to move the carriage 230 toward the bundle due to the leading four-bar linkage inherent characteristics. The entire cutting process of the FIGS. 12A-12E mode of operation in one embodiment is approximately 4 seconds, while the shorter cycle of the FIG. 13 mode of operation is about 3 seconds. The conveyors are all controlled by a control system 196 and monitor (FIG. 14), which receives the information as to the bundle size for each bundle 60 inducted into system 100. Control system 196 (FIG. 14) includes a microprocessor, suitable interface circuits, and memory for storing a program for controlling the movement of the conveyors to sequentially position bundles 60 within the processing station 150 and operate the clamp 160 to hold a bundle in a fixed position for cutting the wrapping and/or bands. The control system 196 also controls the mode and sequence of operation of the cutter assemblies 200 and 300, as seen in FIGS. 12 and 13. A touch screen monitor 195 is coupled to control system 196 for inputting information, and its monitor provides an operator with status information on the system operation. The control system may also include other data input devices, such as CD and DVD drives or network interfaces, for loading programs or other information and data into or out of the computer contained in control system 196. Although photo diodes and sensors provide an interruptible optical beam which is employed to detect and measure bundles, other sensing devices, including ultrasonic sensors, mechanical switches, or proximity detectors, could also be employed. Various types of conveyors other than the preferred belt conveyors likewise can be used to move bundles through the system.

Although the description of this invention is for a stand-alone, manually loaded and unloaded system, in the preferred embodiment of the invention in the combined form of stations 120, 130, 140, 150, and control system 196, the unbundling system is likewise intended to be inserted in the system shown in FIGS. 15A-15E to improve the efficiency of such a system.

It will become apparent to those skilled in the art that various modifications to the preferred embodiment of the invention as described herein can be made without departing from the spirit or scope of the invention as defined by the appended claims.

The invention claimed is:

1. A package sorting system receiving a plurality of bundled packages destined for different areas by a delivery system which may include manual delivery to a postal customer's address, said sorting system including:

a loading station for receiving bundles of preaddressed articles such as magazines, catalogs, brochures, or flyers, each carrying a readable address identifying a location to which the article is to be delivered, wherein said bundles are formed of a group of such articles held together by one of banding members and wrapping material;

an input conveyor for moving the bundles along a path of travel;

a package unbundling station positioned in communication with said input conveyor for receiving bundles enclosed with at least one of wrapping and banding;

at least a pair of spaced-apart movable cutter assemblies that cut said at least one wrapping and banding on at least two sides of bundles in said unbundling station, wherein each of said movable cutter assemblies includes a cutting member which is moved to engage a side of a bundle while in said unbundling station, and wherein said cutter assemblies include:

a support beam positioned along said unbundling station;

a carriage movable along said support beam;

a drive for moving said carriage along said beam; and a first pivot mechanism for pivoting said carriage toward and away from a bundle in said unbundling station, and wherein said cutting member is coupled to said carriage for movement into and out of engagement with a bundle, and wherein said cutting member includes a shoe for engaging at least one of said wrapping and banding on a bundle and a cutting element positioned in association with said shoe to cut said one of wrapping and banding, and wherein said shoe comprises a double ended elongated member having rounded opposed curved ends and one of a center slot and trough aligned with a longitudinal axis of said shoe;

a second pivot mechanism for tilting said shoe toward and away from a bundle as said carriage is moved along said beam;

an output conveyor for receiving unbundled articles; and a work station for receiving unbundled articles from said output conveyor.

2. The system as defined in claim 1 wherein said cutting element comprises a rotating cutting wheel which extends within said slot or trough of said shoe.

3. The system as defined in claim 1 wherein said system includes sensors for determining the width and length of a bundle.

4. The system as defined in claim 1 and further including a sensor for determining whether a bundle exceeds a predetermined height and for controlling the operation of said clamp based upon such determination.

5. The system as defined in claim 1 wherein said clamp has an L-shaped pad for engaging a bundle adjacent two edges.

6. A package unbundling system for removing wrapping and/or banding from bundles of the type having generally vertical opposite side faces, generally vertical front and rear side faces, and generally horizontal top and bottom side faces, the unbundling system comprising:

a conveyor for moving bundles into a fixed stationary position of an unbundling station;

an unbundling station and a clamp for holding the bundle in a fixed position in said unbundling station, the unbundling station including first and second cutter assemblies having movable cutter members positioned adjacent said conveyor that make non-vertical side cuts in the wrapping while a bundle is in said fixed position, said cutters making cuts on at least two adjacent side faces of bundles, the cuts extending substantially across the side faces of the bundles and through the corners defining the ends of said sides, and wherein said cutter assemblies include:

a support beam positioned along said unbundling station;

a carriage movable along said support beam;

a drive for moving said carriage along said beam; and a first pivot mechanism for pivoting said carriage toward and away from a bundle in said unbundling station, and wherein said cutting member is coupled to said carriage for movement into and out of engagement with a bundle, and wherein each cutting member includes a shoe for engaging at least one of said wrapping and banding on a bundle and a cutting element positioned in association with said shoe to cut said one of wrapping and banding;

a second pivot mechanism for tilting said shoe toward and away from a bundle as said carriage is moved along said beam, and wherein said shoe comprises a double ended elongated member having rounded opposed curved ends and one of a center slot and trough aligned with a longitudinal axis of said shoe.

7. The system as defined in claim 6 wherein said cutting element comprises a rotating cutting wheel which extends within said slot or trough of said shoe.

8. A package sorting system receiving a plurality of bundled packages destined for different areas by a delivery system which may include manual delivery to a postal customer's address, said sorting system including:

a loading station for receiving bundles of preaddressed articles such as magazines, catalogs, brochures, or flyers, each carrying a readable address identifying a location to which the article is to be delivered, wherein said bundles are formed of a group of such articles held together by one of banding members and wrapping material;

an input conveyor for moving the bundles along a path of travel;

a package unbundling station positioned in communication with said input conveyor for receiving bundles enclosed with at least one of wrapping and banding;

at least a pair of spaced-apart movable cutter assemblies that cut said at least one wrapping and banding on at least two sides of bundles in said unbundling station, wherein each of said movable cutter assemblies includes a cutting member having a shoe comprising a double ended elongated member having rounded opposed curved ends and one of a center slot and trough aligned with a longitudinal axis of said shoe which is tilted toward and away from a bundle in said unbundling station and moved to engage a side of a bundle while in said unbundling station;

an output conveyor for receiving unbundled articles; and a work station for receiving unbundled articles from said output conveyor.

9. The system as defined in claim 8, including a powered tilt actuator that tilts the shoe toward and away from a bundle in said unbundling station.

10. The system as defined in claim 9, wherein each movable cutter assembly includes a four bar linkage and a powered linkage actuator operably connected to said four bar linkage, whereby said cutting members move toward and away from a bundle in said unbundling station.

11. The system as defined in claim 10, wherein the bundles have a generally quadrilateral perimeter with four corners in plan view, and wherein the cutting member is initially brought into contact with a side of a bundle immediately adjacent a selected one of the corners.

12. The system as defined in claim 11, wherein the cutting member is first moved in a first direction towards said one corner after being brought into contact with a side of a bundle to tear open wrapping at the one corner if wrapping is present, followed by movement in a second direction that is opposite the first direction.

* * * * *